United States Patent [19]

Anderson

[11] Patent Number: 4,731,972

[45] Date of Patent: Mar. 22, 1988

[54] METHOD OF INSTALLING FABRIC WALL PANELS

[75] Inventor: Andy Anderson, Douglasville, Ga.

[73] Assignee: Accutrack, Systems, Inc., Atlanta, Ga.

[21] Appl. No.: 22,177

[22] Filed: Mar. 5, 1987

[51] Int. Cl.[4] ..... E04B 1/00

[52] U.S. Cl. ..... 52/745; 52/822; 52/506; 52/794

[58] Field of Search ..... 52/822, 777, 506, 239, 52/794, 809, 813, 512, 745

[56] References Cited

U.S. PATENT DOCUMENTS

| | | | |
|---|---|---|---|
| 1,171,952 | 2/1916 | Higgin . | |
| 1,588,161 | 6/1926 | Bost . | |
| 3,273,633 | 9/1966 | Seidmon et al. | 160/381 |
| 3,477,574 | 11/1969 | Malfroy | 209/403 |
| 3,489,085 | 1/1970 | Kirkpatrick | 101/415.1 |
| 3,552,476 | 1/1971 | Le Tarte | 160/371 |
| 3,783,931 | 1/1974 | Assael | 160/327 |
| 3,833,046 | 9/1974 | Tombu | 160/327 |
| 4,018,260 | 4/1977 | Baslow | 160/327 |
| 4,548,010 | 10/1985 | Hintsa | 52/822 X |

FOREIGN PATENT DOCUMENTS 910194 1/1960 Denmark .

*Primary Examiner*—Carl D. Friedman

[57] ABSTRACT

There is disclosed a fabric wall panel consisting of a frame formed from linear frame members with a flat insert within the frame and fabric stretched over the frame and glued on the back. The linear frame members have an inside tongue for fastening the frame to a wall and an outside raised channel of three profiles, square, triangle, and quarter round.

2 Claims, 6 Drawing Figures

METHOD OF INSTALLING FABRIC WALL PANELS

BACKGROUND OF THE INVENTION

This invention relates generally to fabric wall panels for use in decorating, and more particularly concerns fabric wall panels which can either be prefabricated and installed as desired or can be custom fabricated at the construction site to provide a precise fit.

In finishing interior space in buildings, fabric wall panels provide a number of highly desirable features. First, the fabric covering provides a large selection of textures and patterns which can be coordinated with the furnishings and carpets in the rooms. In addition, fabric panels also can provide both sound and heat insulation. Particularly, acoustical insulation and muting in large rooms or auditoriums may be highly desirable. In that regard, modification of the room s acoustical characteristics can be achieved further by providing fabric panels which include a layer of acoustical material hidden behind the fabrics.

A number of fabric panels have been proposed such as that shown in Baslow U.S. Pat. No. 4,018,260. The Baslow patent discloses an assembly of border pieces which are permanently attached to the wall to form a framework for mounting a fabric sheet which completely covers the wall without being adhered to the wall itself. The linear border pieces include a keyway into which the fabric is forced by means of a compressible spline and a storage channel which allows the excess material at the edges to be tucked into the border pieces to create a finished look at the edges. Baslow does not disclose a fabric panel which can be prefabricated for attachment to the wall but instead only discloses fabric panels which can be installed in situ.

Wall panel systems which require installation of the frame prior to covering with fabric limit the contractor's ability to realize cost savings through prefabrication where the panels are to be used as accent pieces and do not necessarily have to fit the wall precisely. Moreover, the prior art wall panels inevitably provide a finished edge along which the framing member itself is visible.

SUMMARY OF THE INVENTION

It is therefore an object of the present invention to provide a fabric wall panel which can be prefabricated or custom fabricated in situ and which can then be attached to the wall by means of a unique cross nailing system.

It is also an object of the present invention to provide a method for assembling and installing fabric wall panels in which prefabrication of the panel is done off-site, and the panels are installed by means of cross nailing.

It is an alternative object of the present invention to provide a method for assembling and installing fabric panels in which the frames for the fabric panels are custom fabricated on site by temporary attachment to the walls and then removed, covered, and reattached by means of cross nailing.

It is also an object of the present invention to provide a fabric panel in which the frame members are completely hidden by the fabric once the panel is installed in place.

Other objects and advantages of the present invention will become apparent upon reading the following detailed description and upon reference to the drawings.

DETAILED DESCRIPTION OF THE INVENTION

While the invention will be described in connection with a preferred embodiment, it will be understood that I do not intend to limit the invention to that embodiment. On the contrary, I intend to cover all alternatives, modifications, and equivalents as may be included within the spirit and scope of the invention as defined by the appended claims.

Figure 1:
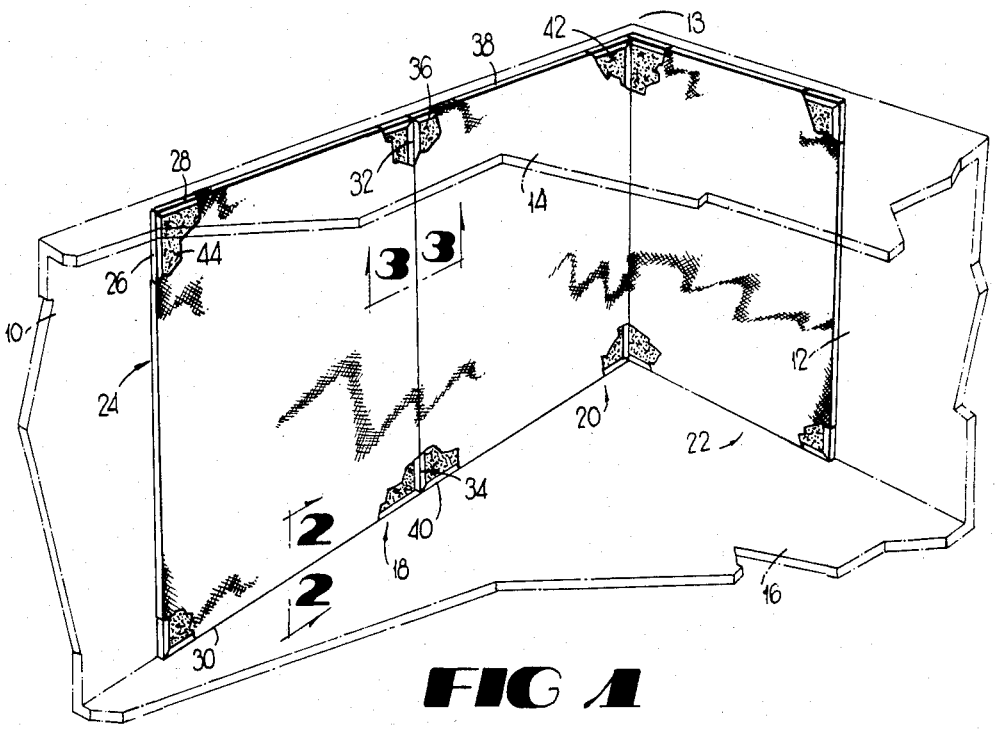
FIG. 1 is a perspective view of walls covered with fabric panels of the present invention.

Turning to FIG. 1, there is shown a portion of a room having an existing back wall 10, an existing side wall 12, an existing ceiling 14, and an existing floor 16. The back wall 10 and side wall 12 converge at a corner 13. The back wall 10 and side wall 12 are covered from floor to ceiling with a series of fabric panels constructed and installed in accordance with the present invention. Of the series of fabric panels, three panels, 18 and 20 on the back wall 10 and panel 22 on the side wall 12, are shown in FIG. 1. Additional panels typically would be added to cover completely the existing wall area.

Figure 2:
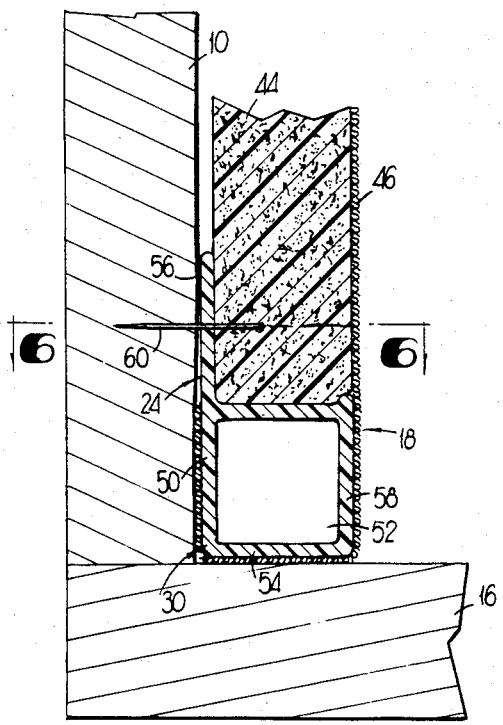
FIG. 2 is a section view of a linear frame member of the present invention as seen along line 2—2 of FIG. 1.
Figure 4:
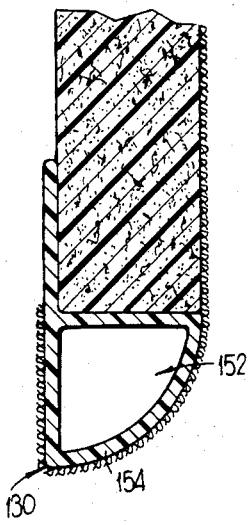
FIG. 4 is a section view of an alternative embodiment of the linear frame member of the present invention.
Figure 5:
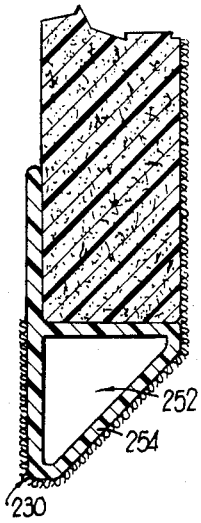
FIG. 5 is a section view of a further embodiment of the linear frame member of the present invention.

Each of the panels 18, 20, and 22 is similarly constructed. With reference to panel 18, it is constructed about a rectangular frame 24 made up of four linear frame members 26, 28, 30, and 32. Likewise, panel 20 has a rectangular frame 34 consisting of four linear frame members 36, 38, 40, and 42. The linear frame members are extrusions made of polyvinyl chloride (PVC). The preferred PVC is 7045 White 08 PVC sold by Georgia Gulf Corporation of Plaquemine, Louisiana. In one embodiment, the linear frame member has a raised channel with a rectangular cross-section (FIG. 2). In another embodiment the linear frame member has a raised channel with a fourth circular cross-section (FIG. 4). In yet another embodiment the linear frame member has a raised channel with a triangular cross-section (FIG. 5).

With continuing reference to FIG. 1, the panel 18 has a flat filler insert 44 laid within the frame 24. The insert 44 may consist of any number of materials to provide sound or heat insulation. Preferably the insert is an acoustical insert in the nature of a rigid board such as Owens/Corning 705 Fiberglas insulation board sold by Owens/Corning Fiberglas Corp. of Toledo, Ohio. Of equal preference is a mineral fiber board insert such as Micore board sold by USG Acoustical Products Company of Chicago, Illinois.

The panel 18 is completed by stretching fabric 46 over the insert 44 and frame 24 and gluing the fabric to the back of the frame 24. 3M high-strength adhesive 90 sold by 3M Company of St. Paul, Minnesota, has been found to be suitable for gluing a large number of fabrics to the PVC material of the frame 24.

Turning to FIG. 2, there is shown in cross-section detail the edge of the fabric panel 18. Particularly, the linear frame piece 30 is shown to include flat spine 50 with a raised hollow channel 52 forming a peripheral edge 54 on one side and with a flat tongue 56 on the other side. The raised hollow channel 52 is rectangular in cross-section. The thickness of the insert 44 is the same as the height of the raised channel 52 so that the top 58 of the raised channel 52 and the fabric side of the insert 44 are essentially co-planar. The fabric 46 is then wrapped around the peripheral edge 54 of the raised channel 52 and adhered to the back of the spine 50.

Figure 6:
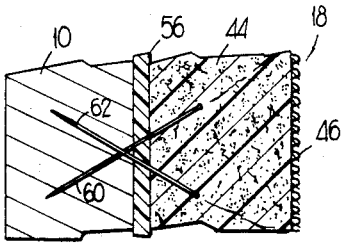
FIG. 6 is a section detail view showing the cross nailed pin nails which hold the fabric panels to existing walls.

When the fabric panel 18 is prefabricated, the linear frame members 26, 28, 30, and 32 are miter-cut and connected together at the corners by suitable fasteners or gluing. The insert 44 is then laid within the raised channels (such as 52 for linear member 30) and glued to the tongue 56. The insert 44 in addition to providing sound and heat insulation also provides rigidity to the frame 24. After gluing the insert 44 to the tongue 56, the fabric 46 is stretched over the frame 24, around the peripheral edges of the raised channels and glued to the back of the spine of the linear frame members. Once the panel 18 has been prefabricated, it is attached to the existing wall 10 by shooting pin nails 60 and 62 (FIG. 6) through the fabric and insert into the tongue 56 and existing wall 10. Pin nails are headless nails which are pheumatically driven. By shooting the pin nails 60 and 62 at an angle as shown in FIG. 6, the headless pin nails penetrate completely through the fabric and most of the way through the insert before being arrested by the combination of the PVC tongue and the existing wall. By driving two pin nails at an angle in the crossed fashion, the tongue of the linear frame member is securely fastened to the wall.

When it is desired that the panels be fabricated on-site to assure an accurate fit, the linear frame members are first cut to the exact size of the space required, and the ends are mitered to accommodate the exact angles of the wall space. Once cut and mitered, the linear frame members are then temporarily tacked to the wall to assure accuracy of the cuts. Temporary attachment may be done by means of pin nails driven straight into the tongue and existing wall. The insert is then cut, fit, and glued into the frame as previously described. The frame and insert are removed from the wall, and the fabric is attached by stretching it over the frame and adhering it to the back of the spine of the linear frame members. With the fabric attached, the fabric panel is reinstalled on the wall by cross pin nailing.

Figure 3:
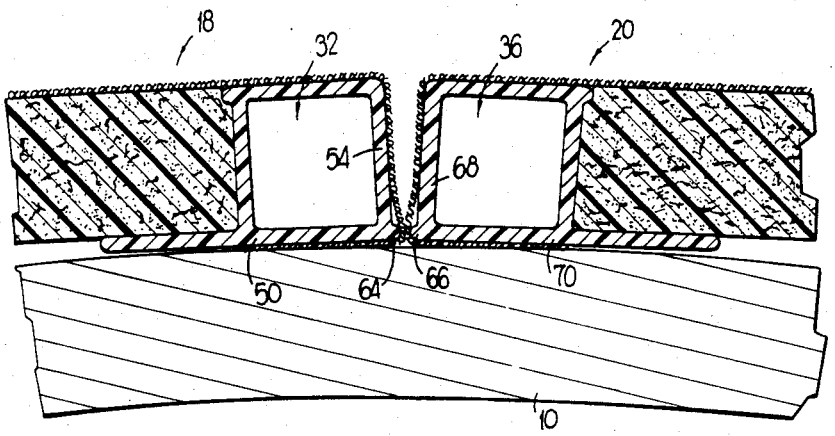
FIG. 3 is a section view of two abutting linear frame members of the present invention.

FIG. 3 shows a linear frame member similar to that shown in FIG. 2, which is used where the existing wall 10 may be irregular, especially bowed. The linear frame members 32 and 36 on adjacent panels 18 and 20 have linear protrusions 64 and 66 along their peripheral edges 54 and 68. The protrusions 64 and 66 are located adjacent spines 50 and 70 close to the existing wall 10. As can be seen in FIG. 3, the protrusions project the fabric into the space 72 between the abutted linear frame members 32 and 36 to assure that the existing wall 10 is not visible through the space 72 created by the bowing of the wall.

FIG. 4 shows an alternative cross-section for linear frame member 130. The linear frame member has a raised channel 152 which is a fourth-circular in cross-section, thereby creating a peripheral edge 154 that is arcuate.

FIG. 5 shows a further alternative embodiment for the linear frame member 230. The linear frame member has a raised channel 252 that is triangular in cross-section with a straight, sloping peripheral edge 254.

I claim:

1. A method for installing a fabric wall panel on an existing wall compriisng the steps of:

a. assembling a frame comprising linear frame members, each linear frame member comprising a flexible flat spine with a front side and a back side and having a raised channel of a preselected height on the front side forming a peripheral edge and an extending tongue on the front side forming an inner edge;

b. inlaying a flat filler insert within the frame on the front side of the spine;

c. bonding the filler insert to the tongue;

d. wrapping the frame with fabric and bonding the fabric to the raised channel along the peripheral edge and along the back of the spine; and e. affixing the fabric panel to the wall by driving pin nails through the tongue in crossed fashion.

2. The method of claim 1, wherein the frame is assembled by pin nailing the linear frame members to the wall in temporary fashion and then removing the frame from the wall after inlaying the filler and prior to wrapping the frame with fabric.

* * * * *